US005328393A

United States Patent [19]

Perret et al.

[11] Patent Number: 5,328,393

[45] Date of Patent: Jul. 12, 1994

[54] ANNULAR ELECTRICAL CONTACT SYSTEM, IN PARTICULAR FOR A CIRCUIT-BREAKER

[75] Inventors: Michel Perret, Bourgoin-Jallieu; Renaud David, Villeurbanne, both of France

[73] Assignee: GEC Alsthom T & D SA, Paris, France

[21] Appl. No.: 27,067

[22] Filed: Mar. 5, 1993

[30] Foreign Application Priority Data

Mar. 6, 1992 [FR] France ..... 92 02725

[51] Int. Cl.[5] ..... H01R 13/187

[52] U.S. Cl. ..... 439/843; 439/840

[58] Field of Search ..... 439/840–847, 439/620, 621, 622

[56] References Cited

U.S. PATENT DOCUMENTS

| | | | |
|---|---|---|---|
| 3,382,479 | 5/1968 | Cooney | 439/840 |
| 4,082,411 | 4/1978 | Storch | 439/843 |
| 4,966,564 | 10/1990 | Foote | 439/841 |

FOREIGN PATENT DOCUMENTS

| | | | |
|---|---|---|---|
| 737823 | 7/1943 | Fed. Rep. of Germany . | |
| 6912957 | 3/1969 | Fed. Rep. of Germany . | |
| 2028177 | 12/1971 | Fed. Rep. of Germany . | |
| 2138989 | 1/1973 | Fed. Rep. of Germany . | |
| 246866 | 6/1987 | German Democratic Rep. . | |
| 447304 | 3/1968 | Switzerland . | |
| 111126 | 11/1917 | United Kingdom | 439/841 |
| 436951 | 11/1926 | United Kingdom | 439/841 |

OTHER PUBLICATIONS

Patent Abstracts of Japan, vol. 016, No. 037 (E-1160) Jan. 29, 1992 & JP-A-32 45 420 (Nisin Electric) Nov. 1, 1991.

Patent Abstracts of Japan, vol. 014, No. 257 (E-936) Jun. 4, 1990 & JP-A-20 78 115 (Fuji Electric) Mar. 19, 1990.

*Primary Examiner*—David L. Pirlot

*Attorney, Agent, or Firm*—Sughrue, Mion, Zinn, Macpeak & Seas

[57] ABSTRACT

The present invention relates to an electrical contact system, in particular for a circuit-breaker, for establishing electrical contact between the respective ends of two conductive tubes (1) and (3) by fitting them together so that the end of one tube is inserted into the end of the other tube. According to the invention, one of the tubes (1), (3) includes a cavity (4) at its end, the cavity having an opening facing the other tube (3), (1) over at least a portion of the periphery of the tube, and a conductive component (2) is held in said cavity (4) which component is in part deformable radially relative to the tube, the conductive component coming into contact with the bottom of the cavity, and projecting out from the opening in the cavity.

6 Claims, 4 Drawing Sheets

ANNULAR ELECTRICAL CONTACT SYSTEM, IN PARTICULAR FOR A CIRCUIT-BREAKER

The present invention relates to an annular electrical contact system for establishing electrical contact between the respective ends of two conductive tubes by fitting them together so that the end of one tube is inserted into the end of the other tube, in particular for an $SF_6$ circuit-breaker.

BACKGROUND OF THE INVENTION

Currently, such contact systems are made by using sets of contact fingers, with each finger being provided with a respective contact pad acting by pressure being applied on the pads by means of the resilience of the fingers or of the resilience of a spring. Such pads are relatively bulky and are installed on the ends of the fingers. Making such fingers requires tubes to be machined, and there are also problems with fixing the pads to the fingers. Moreover, they have sharp edges giving rise to dielectric problems.

OBJECT AND SUMMARY OF THE INVENTION

An object of the invention is to make a contact system that is particularly compact and that has no detrimental sharp edges. Furthermore, this relatively rudimentary system is cheap and intended for a temporary contact.

In particular, the invention relates to an electrical contact system for temporarily connecting interrupting chambers in circuit, which chambers include inserted capacitors, varistors or resistors.

This type of contact system is designed to pass low currents for short periods of time.

According to the invention, one of the tubes includes a cavity at its end, the cavity having an opening facing the other tube over at least a portion of the periphery of the tube, and a conductive component is held in said cavity, which component is in part deformable radially relative to the tube, the conductive component coming into contact with the bottom of the cavity, and projecting out from the opening in the cavity.

In a first variant embodiment, the opening in the cavity faces the other tube and extends over the entire periphery of the tube, and a clip ring is held in said cavity, said clip ring being circular in cross-section and also in overall shape, with radial curves extending in alternate directions in its plane, one series of the radial curves coming in to contact with the bottom of the cavity, and another series of the radial curves projecting out from the cavity.

In this way, at rest, the clip ring is pre-stressed so as to bring it alternately into contact with the bottom of the cavity and with the opening thereof, thereby providing effective electrical contact between the clip ring and the tube in which the clip ring is received.

When the two tubes are fitted together, the portion of the clip ring that projects out from the cavity presses against the inserted rod, the clip ring is in contact with the bottom of the cavity, and current flows particularly effectively between the two tubes.

In a second variant embodiment, the cavity has at least two (and in particular three) openings facing the other tube, each of which openings receives a respective helical spring tensioned inside the cavity, each end of each spring being connected to the respective end of its adjacent spring via a rigid piece which is received in one of the portions of the cavity that is not open and which is permanently in contact with the bottom of the cavity.

Like the clip ring, the spring(s) act(s) by pre-stressing, to establish effective electrical contact between the fitted-together tubes.

So as to avoid contact being completely lost if one of the springs breaks, respective conductive cables interconnect the respective ends of the springs, the cables being riveted to a fixed portion of the tube.

The cavity may be provided by attaching a separate part to the tube, preferably by it being screwed on.

More particularly, the end of the tube and the end of the attached part have respective chamfered shapes cooperating with each other to retain the conductive component(s) inside the cavity.

BRIEF DESCRIPTION OF THE DRAWINGS

The invention is described below in more detail with reference to the accompanying drawings which show only one of the possible embodiments. In the drawings.

MORE DETAILED DESCRIPTION

Figure 1:
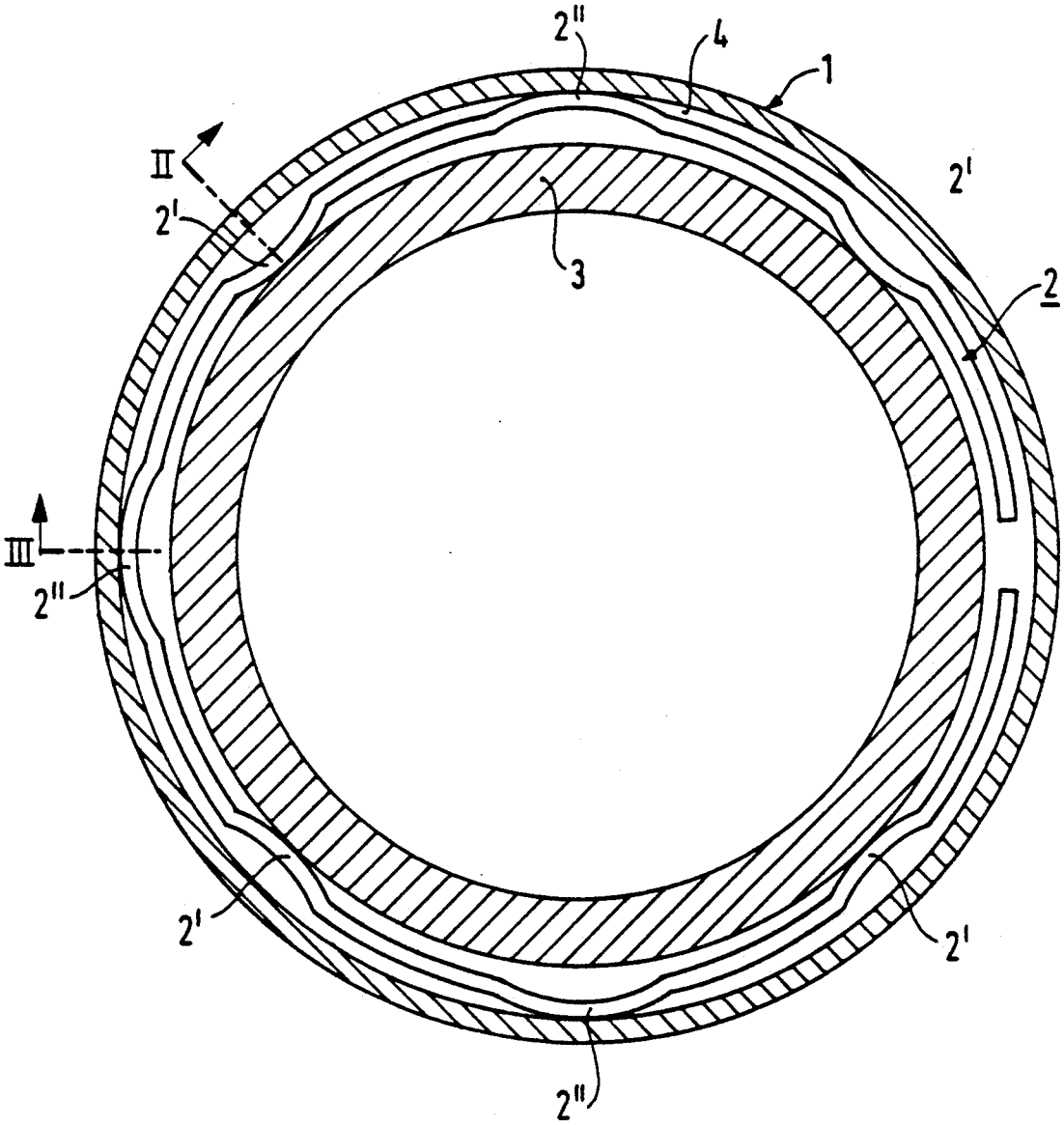
FIG. 1 is a view in cross-section through two tubes fitted together by one being inserted into the other and in electrical contact with each other, in a first variant embodiment.

FIG. 1 is a view in radial section through the two conductive tubes, the fixed outer tube 1 of which supports the clip ring 2 which provides electrical contact between the fixed outer tube 1 and the moving inner tube 3, in the first variant embodiment.

The clip ring 2 is circular in cross-section and includes radial curves or deformations 2' and 2'' disposed alternately, curves 2'' being directed towards the bottom of the cavity 4 provided in the fixed tube 1, and curves 2' being directed towards the opening of the cavity 4. In this way, when the moving tube 3 is inserted, it pushes back curves 2', thereby making good electrical contact, while, by means of pre-stressing, curves 2'' are pushed back against the bottom of the cavity 4. The electrical contact between tubes 1 and 3 is thus established particularly well.

Figure 2:
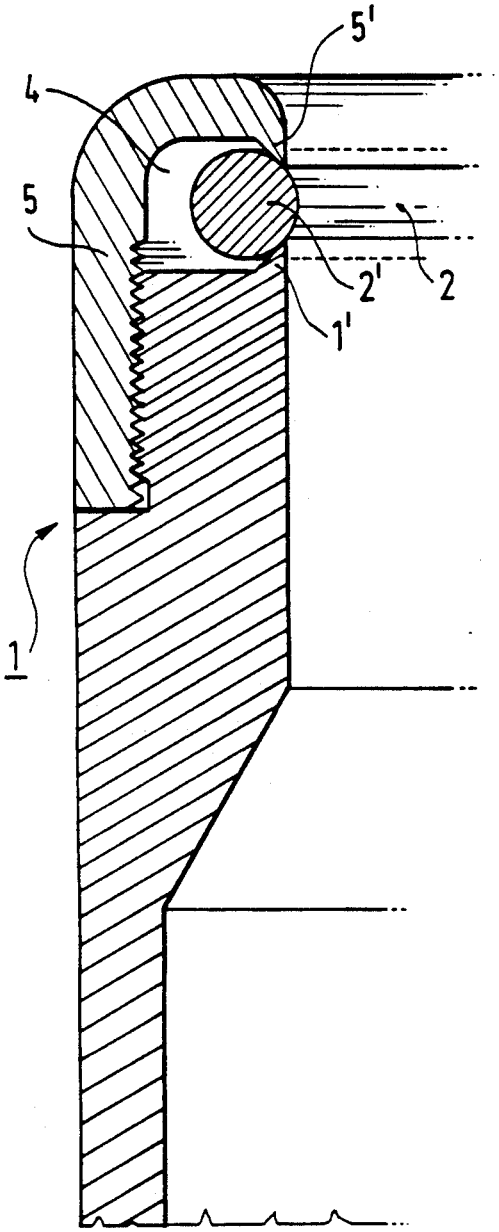
FIG. 2 is a view of an embodiment in longitudinal section through the outer tube, in the rest position, at II in FIG. 1.
Figure 3:
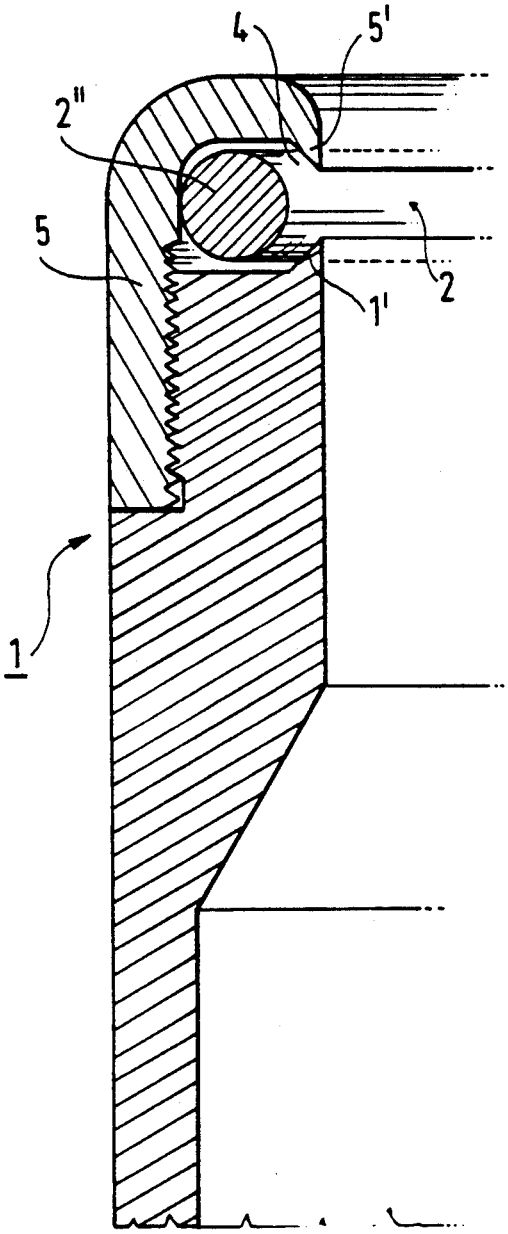
FIG. 3 is a view of an embodiment in longitudinal section through the outer tube, in the rest position, at III in FIG. 1.

FIGS. 2 and 3 show the outer tube 1 provided with the clip ring received in the cavity 4. FIG. 2 shows a curve 2' in the clip ring that is directed towards the outside of the cavity 4, and FIG. 3 shows a curve 2'' bearing against the bottom of the cavity 4.

The cavity 4 is formed by means of an attached part 5 preferably screwed to tube 1. To hold the clip ring in place, tube 1 and tube 5 have respective chamfered edges 1' and 5'' against which curves 2' are pre-stressed, the curves projecting by about 0.5 mm therefrom.

The clip ring is preferably constituted by a high-strength brass wire, a chromium copper wire, or a beryllium bronze wire, obtained by deforming a rectilinear piece.

Figure 4:
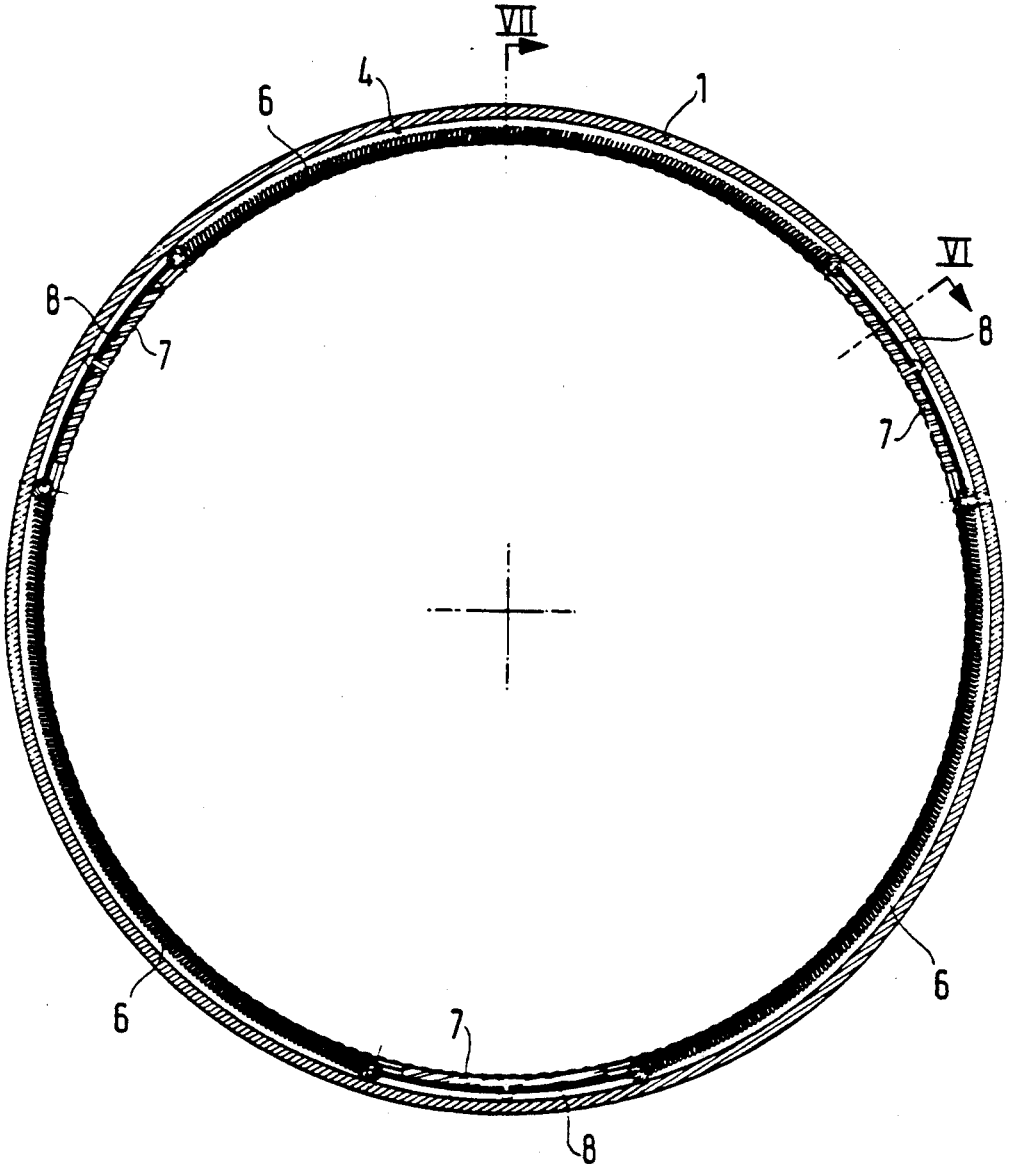
FIG. 4 is a view in cross-section through the tube carrying the electrical contact system, in a second variant embodiment.
Figure 5:
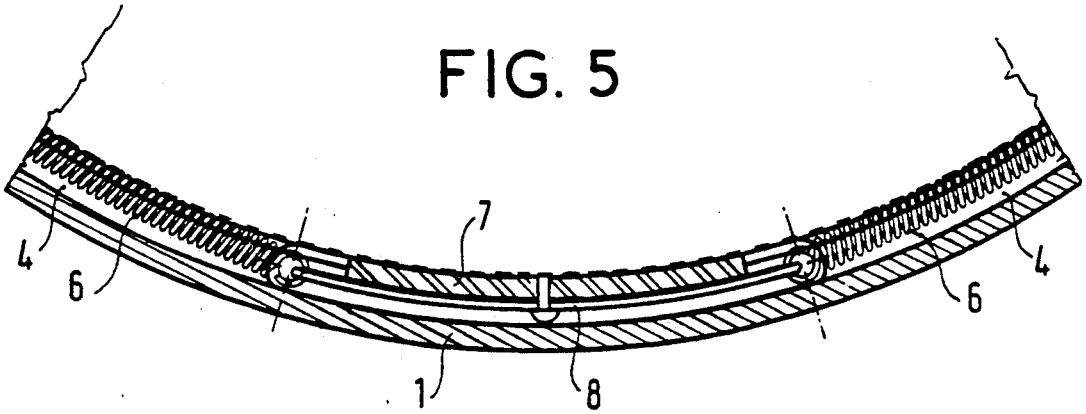
FIG. 5 is a fragmentary view of FIG. 4.

In a second variant embodiment, as shown in FIG. 4, the outer tube 1 has a cavity 4 with three openings facing inwards, i.e. facing towards the position of the inner tube when the inner tube Is inserted. At each opening, a conventional helical spring 6 preferably made of beryllium copper is received in the cavity. Each spring 6 is fixed to a circular-arc shaped rigid piece 7 providing electrical contact with the bottom of the cavity 4. The springs are also connected together via respective cables 8, preferably made of copper wire. Preferably, the cables 8 are riveted to the tube 1 so that, if one spring 6 breaks, the other two remain tensioned, thereby providing electrical contact with the inserted inner tube by means of pre-stressing.

Figure 6:
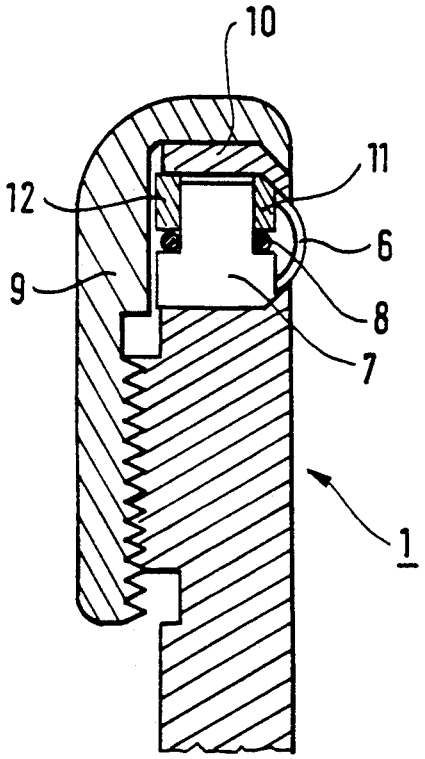
FIG. 6 is a view of an embodiment in longitudinal section through the outer tube at VI in FIG. 4.
Figure 7:
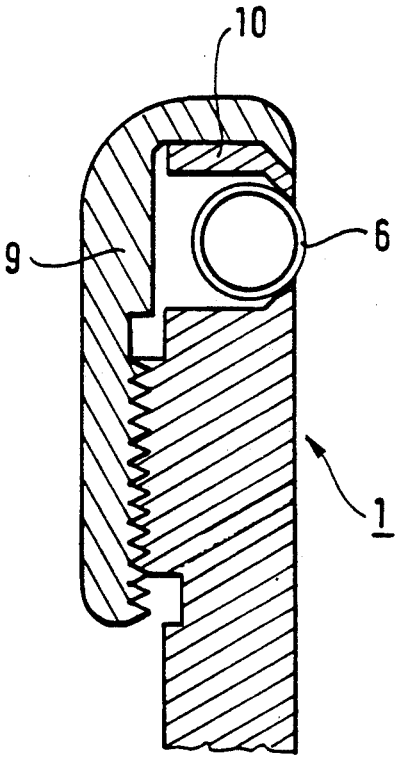
FIG. 7 is a view of an embodiment in section through the outer tube at VII in FIG. 4.

The positioning of the springs 6 and of the rigid pieces 7 is described in more detail with reference to FIGS. 6 and 7.

The cavity 4 is closed and the springs are held in position by parts being attached to tube 1. To be more precise, a main attached part 9 is preferably screwed onto the end of tube 1, and it co-operates with a secondary part 10 to hold the springs 6 in position. For this purpose, the secondary part and the end of the tube 1 have respective chamfered edges, the two chamfered edges holding the springs projecting out of the cavity so as to establish contact with the inner tube by means of pre-stressing, when the inner tube is in the inserted position. Other attached parts position the rigid pieces 7.

We claim:

1. An electrical contact system, in particular for a circuit-breaker, for establishing electrical contact between the respective ends of two conductive tubes by fitting them together so that the end of the one tube is inserted into the end of the other tube, one of the tubes including a cavity at its end, the cavity having a radial opening facing the other tube over at least a portion of the periphery of the tube, a conductive component being held in said cavity, which component is in part deformable radially relative to the tube, the conductive component coming into contact with the bottom of the cavity, and projecting out from the radial opening in the cavity, in which system the radial opening in the cavity faces the other tube and extends over the entire periphery of the tube, and the conductive component is a clip ring held in said cavity, said clip ring being circular in overall plan shape and including a plurality of circumferentially spaced radial curves extending in alternate radial directions in the plane of said circular clip, with one series of radial curves coming into contact with the bottom of the cavity, and another series of radial curves projecting radially out from the cavity for resilient contact with the periphery of the tube lacking said cavity during insertion of one tube into the other tube.

2. An electrical contact system, in particular for a circuit-breaker, for establishing electrical contact between respective ends of two conductive tubes by fitting them together so that an end of one tue is inserted into an end of the other tube, one of the tubes including a cavity at said end, the cavity having a radial opening facing the other tube over at least a portion of the periphery of the tube, a conductive component being held in said cavity, which component is in part deformable radially relative to the tube, the conductive component coming radially into contact with a bottom of the cavity, and projecting out from the radial opening in the cavity for contact with the other of said tubes, in which system the radial cavity has at least two circumferentially spaced radial openings facing the other tube and the conductive component is constituted by two helical springs and at least two rigid pieces, each of said radial openings receiving a respective helical spring tensioned inside the cavity, said springs having opposite ends, each end of each spring being connected to a respective end of a circumferentially adjacent spring via a said rigid piece received in one portion of a cavity that is not radially open and which rigid piece is permanently in contact with the bottom of the cavity.

3. A system according to claim 2, wherein respective conductive cables interconnect the respective ends of circumferentially adjacent springs, and the cables being riveted to a fixed portion of the tube housing said cavity.

4. A contact according to claim 2, wherein the cavity is defined by a separate part attached to the tube.

5. A contact according to claim 4, wherein the separate part is screwed to said tube.

6. A contact according to claim 4, wherein an end of the tube and an oppositely facing end of the attached part have respective chamfered shapes co-operating with each other to retain the conductive component inside the cavity.

* * * * *